US005124242A

United States Patent [19]

Hattori et al.

[11] Patent Number: 5,124,242

[45] Date of Patent: Jun. 23, 1992

[54] SILVER HALIDE PHOTOGRAPHIC ELEMENT WITH HYDROPHOBIC UNDERCOAT POLYMER LAYER AND HYDROPHOBIC DYE LAYER

[75] Inventors: Yasushi Hattori, Kanagawa; Koichi Suematsu, Shizuoka; Shigeru Ohno, Kanagawa, all of Japan

[73] Assignee: Fuji Photo Film Co., Ltd., Kanagawa, Japan

[21] Appl. No.: 641,996

[22] Filed: Jan. 16, 1991

[30] Foreign Application Priority Data

Jan. 16, 1990 [JP] Japan ..... 2-6802

[51] Int. Cl.[5] ..... G03C 1/84

[52] U.S. Cl. ..... 430/510; 430/513; 430/523

[58] Field of Search ..... 430/513, 510, 523

[56] References Cited

U.S. PATENT DOCUMENTS

| | | | |
|---|---|---|---|
| 2,050,588 | 8/1936 | Schneider | 430/513 |
| 4,247,627 | 1/1981 | Chen | 430/510 |
| 4,268,622 | 5/1981 | Adachi et al. | 430/513 |
| 4,311,787 | 1/1982 | Lemahieu et al. | 430/513 |
| 4,368,258 | 1/1983 | Fujiwhara et al. | 430/510 |
| 4,563,406 | 1/1986 | Ohbayashi et al. | 430/513 |
| 4,581,323 | 4/1986 | Fisher et al. | 430/513 |
| 4,695,531 | 9/1987 | Delfino et al. | 430/513 |

*Primary Examiner*—Jack P. Brammer

*Attorney, Agent, or Firm*—Sughrue, Mion, Zinn, Macpeak & Seas

[57] ABSTRACT

A silver halide photographic material comprising a support having on at least one side thereof an undercoat polymer layer, a dye layer comprising hydrophilic colloid and a dye capable of being decolorized during development, and at least one silver halide emulsion layer in that order from the side of the support, wherein hydrophilic colloid in the dye layer is present at a coating weight of not more than about 0.5 g/m$^2$ and the dye layer is dried at a temperature in the range of from about 80° to about 160° C.

19 Claims, No Drawings

SILVER HALIDE PHOTOGRAPHIC ELEMENT WITH HYDROPHOBIC UNDERCOAT POLYMER LAYER AND HYDROPHOBIC DYE LAYER

FIELD OF THE INVENTION

This invention relates to a silver halide photographic material, and more particularly, to a silver halide photographic material having a dye layer.

BACKGROUND OF THE INVENTION

In silver halide photographic materials, photographic emulsion layers or other layers are often colored to allow light in a specific wavelength region to be absorbed.

A colored layer is provided between a photographic emulsion layer and a support or on the surface of the support which is opposite to the photographic emulsion layer, to prevent fuzz, that is, halation, from being caused by light scattered when incident light passes through photographic emulsion layers. A colored layer is also provided to prevent halation which occurs when incident light is reflected at the interface between the emulsion layer and the support or on the surface of the support which is opposite to the emulsion layer, and the reflected light enters the photographic emulsion layers again. Such a colored layer is called an antihalation layer.

In X-ray photographic materials, a colored layer is sometimes provided to improve sharpness, which functions as a cross-over cut filter which reduces cross-over light.

The layers to be colored generally comprise hydrophilic colloid. Dyes are generally incorporated in the layers to color them. It is necessary that the dyes meet the following requirements.

(1) The dyes have proper spectral absorption according to use.

(2) The dyes are inactive photographically and chemically. Namely, the dyes do not have any adverse effect on the performance of silver halide photographic emulsion layers in a chemical sense. For example, they do not cause a lowering in sensitivity, the degradation of latent images, or fogging.

(3) The dyes are decolorized or removed by dissolution during the course of processing, and any harmful color is not left on the photographic materials after processing.

However, when a colored layer such as an antihalation layer or a cross-over cut layer is formed by using hydrophilic colloid, the volume of the water-permeable layers increases, and as a result, drying characteristics during development deteriorate.

In order to solve this problem, studies have been conducted to fix dyes into a layer which is used to improve the adhesion between the hydrophilic colloid layer and the support. (The layer which plays a role in bonding the support to the hydrophilic colloid layer is referred to herein as the undercoat layer). Methods for fixing dyes into the undercoat layer include a method wherein a dye is allowed to be adsorbed by a mordant as described in Japanese Patent Application No. 62-224447, and U.S. Pat. Nos. 4,957,856 and 4,965,180, a method wherein a dye dissolved in oil as oil droplets is emulsified and dispersed as described in Japanese Patent Application No. 1-142688, a method wherein a dye is adsorbed on the surface of an inorganic material as described in Japanese Patent Application No. 1-139691, a method wherein a dye is adsorbed by a polymer as described in Japanese Patent Application No. 1-119851 and a method wherein a dye in the form of a solid is dispersed as described in Japanese Patent Application No. 1-87637, and U.S. Pat. Nos. 4,803,150 and 4,900,652. The examples in these patent specifications disclose that an undercoating polymer layer and a dye layer are coated in such a form that they are adjacent to each other.

Such a coating form has a disadvantage in that the dye is introduced into the undercoating polymer and is left as a residual color after development.

It is believed that the dye enters into the gaps of the undercoating polymer and is confined in the polymer during the drying of the dye layer, whereby the residual color is formed.

SUMMARY OF THE INVENTION

An object of the present invention is to provide a silver halide photographic material which is provided with an antihalation layer or a cross-over cut layer which scarcely forms a residual color without increasing the amount of hydrophilic colloid and which has excellent adhesion and drying characteristics after processing.

The above-described object has been achieved by providing a silver halide photographic material comprising a support having on at least one side thereof an undercoat polymer layer, a dye layer comprising hydrophilic colloid and a dye capable of being decolorized during the course of development, and at least one silver halide emulsion layer in that order from the side of the support, wherein the hydrophilic colloid in the dye layer is present at a coating weight of not more than about 0.5 $g/m^2$ and the dye layer is dried at a temperature in the range of from about 80° to about 160° C.

The above-mentioned problems in the art have been solved by providing the above-described photographic material according to the present invention.

The above-described layers according to the present invention may be provided on both sides of the support.

DETAILED DESCRIPTION OF THE INVENTION

Methods for coating the undercoat layer include a method called a multi-layer coating method wherein a layer which is well bonded to the support is provided as a first layer on the support and a hydrophilic layer as a second layer is coated thereon as described in JP-A-2-49019 (the term "JP-A" as used herein means an "unexamined published Japanese patent application"), JP-A-52-42114 and JP-A-52-104913, and a method wherein only a single layer of a polymer layer having both a hydrophobic group and a hydrophilic group is coated as described in JP-B-47-24270 (the term "JP-B" as used herein means an "examined Japanese patent publication") and JP-A-51-30274. Any of the above-described methods can be used in the present invention. However, the multi-coating method provides preferable results.

Both the undercoat polymer layer and the dye layer can be dried at a temperature not lower than about 80° C. after coating. When they are dried at a temperature lower than about 80° C., the adhesion between the support and the photographic layer (e.g., silver halide emulsion layer) is poor, and a problem may result in which the photographic layer peels off during the course of automatic processing.

The undercoat polymer layer is dried at a temperature below about 220° C. preferably at a temperature in the range of from 80° C. to 190° C., for a period of from 1 to 120 seconds, preferably from 5 to 30 seconds.

When the drying temperature of the dye layer is higher than about 160° C., a problem occurs in which the dye fuses to the undercoat polymer during the drying of the dye layer, so the dye is confined in the undercoat polymer and cannot be removed during processing and as a result, a residual color is formed.

For this reason, the drying temperature of the dye layer is in the range of from about 80° to about 160° C., preferably 100° to 160° C., and more preferably 120° to 150° C.

When both the undercoat polymer layer and the dye layer are dried at a temperature not lower than about 80° C. after coating, the adhesion between the support and the photographic layer (e.g., the silver halide emulsion layer) can be enhanced.

Surface treatment of the support before the coating of the undercoat layer gives favorable results for the present invention. Examples of surface treatments include methods such as chemical treatment, mechanical treatment, corona discharge treatment, flame treatment, ultraviolet light treatment, high frequency treatment, glow discharge treatment, actinic plasma treatment, laser treatment, mixed acid treatment and ozone treatment.

Examples of undercoat polymers used for the undercoat layer include halogen-containing synthetic resins such as polyvinyl chloride, polyvinyl bromide, polyvinyl fluoride, polyvinylidene chloride, polyvinyl acetate, chlorinated polyethylene, chlorinated polypropylene, brominated polyethylene, chlorinated rubber, vinyl chloride-ethylene copolymer, vinyl chloride-propylene copolymer, vinyl chloride-styrene copolymer, vinyl chloride-isobutylene copolymer, vinyl chloride-vinylidene chloride copolymer, vinyl chloride-styrene-maleic anhydride terpolymer, vinyl chloride-styreneacrylonitrile terpolymer, vinyl chloride-butadiene copolymer, vinyl chloride-isoprene copolymer, vinyl chloride-chlorinated propylene copolymer, vinyl chloride-vinylidene chloride-vinyl acetate terpolymer, vinyl chloride-acrylic ester copolymers, vinyl chloride-maleic ester copolymers, vinyl chloride-methacrylic ester copolymers, vinyl chloride-acrylonitrile copolymer, internally plasticized polyvinyl chloride, vinyl chloride-vinyl acetate copolymer, polyvinylidene chloride, vinylidene chloride-methacrylic ester copolymers, vinylidene chloride-acrylonitrile copolymer, vinylidene chloride-acrylic ester copolymer, chloroethyl vinyl ether-acrylic ester copolymers and polyvinylidene fluoride; α-olefin polymers such as polyethylene, polypropylene, polybutene and poly-3-methylbutene and copolymers thereof; polyolefins such as ethylene-propylene copolymer, ethylene-propylene-1,4-hexadiene terpolymer, ethylene-vinyl acetate copolymer, copolybutene-1-propylene and butadiene-acrylonitrile copolymer and blends of these polyolefins and halogen-containing resins; acrylic resins such as acrylic ester-acrylonitrile copolymers, acrylic ester-styrene copolymers, methacrylic ester-acrylonitrile copolymers, methacrylic ester-styrene copolymers, polyalkyl acrylates, acrylic acid-butyl acrylate copolymer, acrylic ester-butadiene-styrene copolymer, methacrylic ester-butadiene-styrene terpolymer, methyl methacrylate/ethyl acrylate/2-hydroxyethyl acrylate/methacrylic acid (67/23/7/3 ratio by weight) polymer, methyl methacrylate/ethyl acrylate/2-hydroxyethyl acrylate/methacrylic acid (72/17/7/3 ratio by weight) polymer, methyl methacrylate/ethyl acrylate/2-hydroxyethyl acrylate/methacrylic acid (70/20/7/3 ratio by weight) polymer and methyl methacrylate/butyl acrylate/2-hydroxyethyl acrylate/methacrylic acid (70/20/7/3 ratio by weight) polymer; polystyrene and copolymers of styrene with other monomers (e.g., maleic anhydride, butadiene, acrylonitrile, etc.); acrylonitrile-butadiene-styrene terpolymer, polyacetal and polyvinyl alcohol and blends of these polymers, block copolymers thereof and graft copolymers thereof; polyamide resin, polyvinyl butyral, polyester resin, cellulose derivatives and vinyl polymers such as polyvinyl alcohol; condensed highmolecular weight compounds such as polycarbonates and polyethers; natural and synthetic rubbers such as natural rubber, butyl rubber, neoprene rubber, styrene-butadiene copolymer rubber, silicone rubber and polyurethane; polyamide, urethane elastomer, nylon-silicone resin, nitrocellulose-polyamide resin and blends of these acrylic resins, methacrylic resins, polyolefin resins, polyamide resins, polyester resins, polyurethane resins, polycarbonate resins, rubber and cellulose resins, water-soluble polyesters, block copolymers thereof and graft copolymers thereof. Among these polymers, styrene-butadiene copolymer and vinylidene chloride copolymers are particularly preferred.

It is preferred that hydrophobic polymers are used for the undercoat of printing photographic material to prevent dimensional stability from being deteriorated by water which the support absorbs during processing. Vinylidene chloride polymers are preferable.

The most preferred form of the polymers in the present invention is latex.

When the dye layer is introduced to improve image quality, it preferably contains a dye which absorbs light in the light-sensitive region of the photographic material.

The amount of the dye layer is preferably about 1 to about 1000 mg/m$^2$, more preferably 10 to 300 mg/m$^2$. When the amount of hydrophilic colloid is large, the amount of water absorption increases, and drying characteristics deteriorate. Accordingly, a small amount of water is preferable. Specifically, the amount of hydrophilic colloid is preferably 10 to 500 mg/m$^2$, more preferably 10 to 200 mg/m$^2$. The ratio by weight of dye/hydrophilic colloid is preferably at least about 0.15, and more preferably at least 0.5.

Methods for dispersing dyes include a method wherein a dye is allowed to be adsorbed by a mordant as described in Japanese Patent Application No. 62-224447, and U.S. Pat. Nos. 4,957,856 and 4,965,180, a method wherein a dye dissolved in oil as oil droplets is emulsified and dispersed as described in Japanese Patent Application No. 1-142688, a method wherein a dye is adsorbed on the surface of an inorganic material as described in Japanese Patent Application No. 1-139691, a method wherein a dye is adsorbed by a polymer as described in Japanese Patent Application No. 1-119851 and a method wherein a dye in the form of a solid is dispersed as described in Japanese Patent Application No. 1-87367, and U.S. Pat. No. 4,803,150 and 4,900,652.

In the present invention, the above-described dispersion methods may be used or other conventional dispersion methods may be used.

It is preferred that the dyes are fixed in a specific layer (the dye layer) of the coated layers. If the dyes are not fixed, a problem results in which the dyes are diffused in the emulsion layer and a lowering in sensitivity is caused. Further, the dyes to be used must be those which are decolorized during processing. When the dyes which are not decolorized are used, a residual color is formed after processing. As the mechanism for decolorizing the dyes, the dyes may be decolorized by the addition thereof to sulfite or may be dissolved out and removed. Preferred dyes vary depending on the dispersion methods thereof in the layer. Dyes and preferred dispersion methods to be used for them include the following dyes and methods. However, the present invention is not limited thereto.

Dyes which can be preferably used vary depending on the method used to disperse the dyes in the layer. When the dyes are allowed to be adsorbed by a mordant, dyes described in Japanese Patent Application No. 62-22447 and U.S. Pat. Nos. 4,957,856 and 4,965,180 are preferred. When dyes dissolved in oil are to be emulsified and dispersed as oil droplets, dyes described in Japanese Patent Application No. 1-142688 and U.S. Patent Application Ser. No. 07/533,542 are preferred. When dyes are allowed to be adsorbed by inorganic materials, dyes described in Japanese Patent Application No. 1-139691 and U.S. Patent Application Ser. No. 07/531,426 are preferred. When dyes are adsorbed by polymers, dyes described in Japanese Patent Application No. 1-119851 are preferred. When dyes in the form of a solid are dispersed, dyes described in Japanese Patent Application No. 1-87367, W088/04794, JP-A-52-92716 and JP-A-55-120030 are preferred.

Silver halide grains in the emulsion may have a regular crystal form such as a cube, octahedron, tetradecahedron or rhombic dodecahedron, an irregular crystal form such as a sphere, a tabular form or a potato form or a composite form of these crystal forms. A mixture of grains having various crystal forms may be used. Tabular grains having a grain size which is at least 5 times the thickness of grain can be preferably used in the present invention. (The details of the tabular grains are described in *Research Disclosure*, Vol. 225, Item 22534, pages 20–58 (January 1983), JP-A-58-127921 and JP-A-58-113926).

Sensitive silver halide emulsion used in the present invention may be a mixture of two or more silver halide emulsions. The silver halide emulsions to be mixed with each other may be different from each other in grain size, halogen composition, sensitivity, etc. A substantially non-sensitive emulsion (the surface or interior thereof may be fogged or not fogged) may be mixed with the sensitive emulsion, or they may be contained in separate layers (the details thereof are described in U.S. Pat. Nos. 2,996,382 and 3,397,987). For example, a sensitive emulsion comprising spherical or potato-form grains and a sensitive silver halide emulsion comprising tabular grains having a grain size of at least 5 times the thickness of grain may be used for the same layer or separate layers as described in JP-A-58-127921. When these emulsions are contained in the separate layers, the sensitive silver halide emulsion comprising the tabular grains may be positioned nearer to the support or farther away from the support.

The photographic emulsion of the present invention can be prepared according to the methods described in P. Glafkides, *Chimie et Physique Photo-graphique* (Paul Montel, 1967), G.F. Duffin, *Photographic Emulsion Chemistry* (The Focal Press, 1966), V.L. Zelikman et al., *Making and Coating Photographic Emulsion* (The Focal Press, 1964), JP-A-58-127921 and JP-A-58-113926. Specifically, any of the acid process, the neutral process and the ammonia process can be used. A soluble silver salt and a soluble halide can be reacted in accordance with the single jet process, the double jet process, or a combination thereof.

A reverse mixing method can be used in which silver halide grains are formed in the presence of excess silver ions or by a controlled double jet process in which the pAg value in the liquid phase in which silver halide is formed is kept constant. According to this process, a silver halide emulsion comprising silver halide grains in which the crystal form is regular and the grain size is nearly uniform can be obtained.

The crystal structure of the silver halide grain may be uniform throughout the whole grain or may be a laminar structure in which the interior of the grain and the surface thereof are different in crystal structure from each other. The crystal structure may also be a conversion type as described in British Patent 635,841 and U.S. Pat. No. 3,622,318.

Cadmium salt, zinc salt, lead salt, thallium salt, iridium salt or complex salt thereof, rhodium salt or complex salt thereof, or iron salt or complex salt thereof may be present during the course of the formation of the silver halide grains or the physical ripening thereof in the preparation of the silver halide.

Solvents for silver halide, such as ammonia, thioether compounds, thiazolidine-2-thione, tetra-substituted ureas, potassium rhodanide, ammonium rhodanide and amine compounds may be present during the formation of the grains to control the growth of the grains.

The silver halide emulsion used in the present invention may or may not be subjected to chemical sensitization. Conventional chemical sensitization methods such as sulfur sensitization, reduction sensitization, or gold sensitization, singly or in combination, can be used.

Gold sensitization, which is a typical method of noble metal sensitization, uses gold compounds, typically gold complex salts. Noble metals, such as complex salts of platinum, palladium and iridium, other than gold may also be used. Specific examples thereof are described in U.S. Pat. No. 2,448,060 and British Patent 618,061.

Sulfur sensitizing agents include sulfur compounds contained in gelatin and various other sulfur compounds such as thiosulfates, thioureas, thiazoles and rhodanine.

Reduction sensitizing agents include stannous salts, amines, formamidinesulfinic acids and silane compounds.

The photographic emulsion of the present invention may contain various compounds to prevent fog during the course of preparation of photographic materials or the storage or processing thereof or to stabilize photographic performance. For example, the photographic emulsion may contain anti-fogging agents or stabilizers such as azoles (e.g., benzthiazolium salts, nitroimidazoles, nitrobenzimidazoles, chlorobenzimidazoles, bromobenzimidazoles, nitroindazoles, benztriazoles, aminotriazoles, etc.); mercapto compounds (e.g., mercaptothiazoles, mercaptobenzthiazoles, mercaptobenzimidazoles, mercaptothiadiazoles, mercaptotetrazoles (particularly, 1-phenyl-5-mercaptotetrazole), mercaptopyrimidines, mercaptotriazines, etc.); thioketo compounds (e.g., oxazolinethione); azaindenes (e.g., triazaindenes, tetraazaindenes (particularly 4-hydroxy substituted (1,3,3a,7tetraazaindenes), pentaazaindenes, etc.); and benzenethiosulfonamide, benzenesulfinic acid and benzenesulfonamide.

Particularly, nitron and derivatives thereof described in JP-A-60-76743 and JP-A-60-87322, mercapto compounds described in JP-A-60-80839 and heterocyclic compounds and complex salts of heterocyclic compounds with silver (e.g., 1-phenyl-5-mercaptotetrazole silver) described in JP-A-57-164735 can preferably be used.

The sensitive silver halide emulsion of the present invention may be spectrally sensitized to blue light, green light or red light having a relatively long wavelength or infrared light by using sensitizing dyes. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing dyes may be present in any stage during the manufacture of the photographic emulsion or may be used in any stage just before coating after the preparation of the emulsion. Examples of the former case include the silver halide grain forming stage, physical ripening stage and chemical ripening stage. Examples of the latter case include a stage just after the chemical ripening and a stage just after the preparation of a coating emulsion.

The photographic emulsion layer or other hydrophilic colloid layers of the photographic material of the present invention may contain various surfactants as coating aids or for the purpose of imparting antistatic properties, improving slipperiness, emulsification dispersion and photographic characteristics (e.g., development acceleration, high contrast, sensitization, etc.) or preventing sticking.

Examples of the surfactants include nonionic surfactants such as saponin (steroid), alkylene oxide derivatives (e.g., polyethylene glycol, polyethylene glycol/polypropylene glycol condensate, polyethylene glycol alkyl ethers, polyethylene glycol alkylaryl ether, polyethylene oxide adducts of silicone), and alkyl esters of saccharose; anionic surfactants such as alkylsulfonates, alkylbenzenesulfonates, alkylnaphthalenesulfonates, alkylsulfuric esters, N-acyl-N-alkyltaurines, sulfosuccinic esters and sulfoalkylpolyoxyethylene alkylphenyl ethers; ampholytic surfactants such as alkylbetaines and alkylsulfobetains; and cationic surfactants such as aliphatic or aromatic quaternary ammonium salts, pyridinium salts and imidazolium salts. Of these, the surfactants which are particularly preferred include saponin; anionic surfactants such as the sodium salt of dodecylbenzenesulfonic acid, di-2-ethylhexyl sodium α-sulfosuccinate, the sodium salt of p-octylphenoxyethoxyethoxyethanesulfonic acid, the sodium salt of dodecylsulfuric acid, the sodium salt of triisopropylnaphthalenesulfonic acid and the sodium salt of N-methyl-oleyltaurine; cationic surfactants such as dodecyltrimethylammonium chloride, N-oleyl-N',N'-trimethylammoniodiaminopropane bromide and dodecylpyridium chloride; betaines such as N-dodecyl-N,N-dimethylcarboxybetaine and N-oleyl-N,N-dimethylsulfobutylbetaine; and nonionic surfactants such as poly (average polymerization degree n=10)oxyethylene cetyl ether, poly(n=25)oxyethylene p-nonylphenol ether and bis(1-poly(n=15)oxyethylene oxy-2,4-di-t-pentylphenyl) ethane.

Preferred examples of the antistatic agents include fluorine-containing surfactants such as the potassium salt of perfluorooctanesulfonic acid, the sodium salt of N-propyl-N-perfluorooctanesulfonylglycine, the sodium salt of N-propyl-N-perfluorooctanesulfonylaminoethyloxy poly(n=3)oxyethylene butanesulfonic acid, N-perfluorooctanesulfonyl-N',N',N'-trimethylammoniodiaminopropane chloride and N-perfluorodecanoylaminopropyl-N',N'-dimethyl-N'-carboxybetaine; nonionic surfactants described in JP-A-60-80848, JP-A-61-112144, JP-A-62-172343, and JP-A-62-173459; and alkali metal nitrates, electrically conductive tin oxide, zinc oxide, vanadium pentoxide and composite oxides obtained by doping these oxides with antimony, etc.

Examples of the matting agent which can be used in the present invention include fine particles of organic compounds such as polymethyl methacrylate homopolymer, copolymer of methyl methacrylate with acrylic acid and starch and fine particles of inorganic compounds such as silica and titanium dioxide. The particle size is preferably about 1.0 to about 10 μm, particularly preferably 2 to 5 μm.

Silicone compounds described in U.S. Pat. Nos. 3,489,576 and 4,047,958, colloidal silica described in JP-B-56-23139, paraffin wax, higher fatty acid esters and starch derivatives can be used as slip agents in the surface layer of the photographic material of the present invention.

Polyols such as trimethylol propane, pentanediol, butanediol, ethylene glycol and glycerin can be used as plasticizers for the hydrophilic colloid layers of the photographic material of the present invention. It is preferred that the hydrophilic colloid layers of the photographic material of the present invention contain a polymer latex to improve pressure resistance. Preferred examples of the polymer include homopolymers of alkyl esters of acrylic acid, copolymers of acrylic alkyl esters with acrylic acid, styrene-butadiene copolymer and polymers or copolymers of monomers having an active methylene group.

The photographic emulsion and non-sensitive hydrophilic colloid layers of the present invention may contain inorganic or organic hardening agents. Examples of the hardening agents include chromium salts, aldehydes (e.g., formaldehyde, glutaraldehyde), N-methylol compounds (e.g., dimethylol urea), active vinyl compounds (e.g., 1,3,5-triacryloyl-hexahydro-s-triazine), bis(vinylsulfonyl)methyl ether, N,N'-methylene-bis[β-(vinylsulfonyl)propionamide], etc.), active halogen compounds (e.g., 2,4-dichloro-6-hydroxy-s-triazine), mucohalogenic acids (e.g., mucochloric acid), N-carbamoylpyridinium salts (e.g., (1-morpholinocarbonyl-3-pyridinio)methane sulfonate) and haloamidinium salts (e.g., 1-(1-chloro-1-pyridinomethylene)pyrrolidinium 2naphthalenesulfonate). These compounds may be used either alone or in combination. Among them, active vinyl compounds described in JP-A-53-41226, JP-A-53-57257, JP-A-59-162546 and JP-A-60-80846 and active halogen compounds described in U.S. Pat. No. 3,325,287 are preferred.

It is preferred that the hydrophilic colloid layers other than the dye-containing layer are hardened by a hardening agent for gelatin so as to give a swelling ratio of not higher than 250%, particularly not higher than 200% in water when the photographic material of the present invention is used as an X-ray photographic material.

Gelatin can be advantageously used as a binder or protective colloid for the emulsion layer and interlayer of the photographic material of the present invention. However, other hydrophilic colloids can be used also.

Examples of other hydrophilic colloids which can be used in the present invention include various synthetic hydrophilic high-molecular weight materials such as dextran, polyvinyl alcohol, polyvinyl alcohol partial acetal, poly-N-vinylpyrrolidone, polyacrylic acid, polyacrylamide and polyvinylimidazole, and copolymers thereof.

Lime-processed gelatin, acid-processed gelatin and enzyme-treated gelatin may be used as gelatin for the present invention. Gelatin hydrolyzate can also be used.

Color forming couplers can be added to the photographic emulsion layer of the photographic material of the present invention. Namely, compounds which form a color by the coupling reaction thereof with aromatic primary amine developing agents (e.g., phenylenediamine derivatives and aminophenol derivatives) in color development can be used. Such compounds include magenta couplers such as 5-pyrazolone couplers, pyrazolobenzimidazole couplers, cyanoacetylcoumarone couplers and open chain acylacetonitrile couplers; yellow couplers such as acylacetamide couplers (e.g., benzoylacetanilides, pivaloylacetanilides, etc.); and cyan couplers such as naphthol couplers and phenol couplers. It is preferred that these couplers are nondiffusing couplers having a hydrophobic group (called a ballast group) in the molecule. The couplers may be any of four equivalent type and two equivalent type for silver ion. The couplers may be any of colored couplers having a color correction effect and couplers releasing a development inhibitor with development (called DIR couplers).

In addition to DIR couplers, the emulsion layer may contain non-color forming DIR couplers which release a development inhibitor and produce colorless coupling reaction products.

There is no particular limitation with regard to other constituents of the emulsion layer of the silver halide photographic material of the present invention. If desired, various additives may be optionally used. For example, binders, surfactants, dyes, ultraviolet light absorbers, hardening agents, coating aids, thickeners, etc., as described in *Research Disclosure*, Vol. 176, pages 22-28 (December, 1978) can be used.

Any conventional method and conventional processing solution described in *Research Disclosure*, No. 176, pages 28-30 (RD-17643) can be applied to the photographic processing of the photographic material of the present invention. The photographic processing may be any photographic processing that forms a silver image (black-and-white photographic processing) or photographic processing that forms a dye image (color photographic processing) depending on the intended purpose. The processing temperature is generally in the range of 18° to 50° C.

Developing solutions for use in black and white photographic processing may contain conventional developing agents. Examples of the developing agents include dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combination.

Generally, the developing solutions contain conventional preservatives, alkaline agents, pH buffering agents and anti-fogging agents. If desired, the developing solutions may optionally contain dissolution aids, color toning agents, development accelerators (e.g., quaternary salts, hydrazine, benzyl alcohol), surfactants, anti-foaming agents, water softeners, hardening agents (e.g., glutaraldehyde), tackifiers, etc.

Any conventional development method for forming a positive silver image by known reversal processing can be applied to the photographic material of the present invention. Further, any black-and-white reversal photographic processing development method can be used in the present invention. Conventional processing solutions can be used. The processing temperature is generally in the range of 18° to 65° C. However, a temperature lower than 18° C. or higher than 65° C. may be used.

Generally, reversal development comprises the following stages: first development-rinsing-bleaching-cleaning-whole surface exposure-second development-fixing-rinsing-drying.

Developing solutions used for the black and white photographic processing of the first development stage may contain conventional developing agents. Examples of the developing agents include dihydroxy-benzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid and heterocyclic compounds having a condensed ring as formed by the condensation of a 1,2,3,4-tetrahydroquinoline ring with an indolene ring as described in U.S. Pat. No. 4,067,872. These compounds may be used either alone or in combination. It is particularly preferred that dihydroxybenzenes are used in combination with pyrazolidones and/or aminophenols. Generally, the developing solutions contain conventional preservatives, alkaline agents, pH buffering agents and anti-fogging agents. If desired, the developing solutions may optionally contain dissolution aids, color toning agents, development accelerators, surfactants, anti-foaming agents, water softeners, hardening agents, tackifiers, etc. The photographic material of the present invention is generally processed with developing solutions containing a sulfite ion as a preservative in an amount of at least 0.15 mol/l.

The pH of the developing solutions is preferably in the range of from about 9 to about 11, and particularly preferably 9.5 to 10.5.

The first developing solutions contain a solvent for silver halide, such as NaSCN in an amount of about 0.5 to about 6 g/l.

Conventional black-and-white developing solutions can be used as the second developing solutions. Specifically, the second developing solutions have a composition obtained by removing the solvent for silver halide from the first developing solutions. The pH of the second developing solutions is preferably in the range of 9 to 11, and particularly preferably 9.5 to 10.5.

The bleaching solutions contain a bleaching agent such as potassium dichromate or cerium sulfate.

The fixing solutions preferably contain thiosulfates and thiocyanates. If desired, the fixing solutions may contain water-soluble aluminum salts.

As a specific type of development, a method may be used wherein the developing agent is incorporated into the photographic material, for example, into the emulsion layer thereof, and the development is carried out by processing the photographic material in an aqueous alkaline solution. Of the developing agents, hydrophobic developing agents can be incorporated into the emulsion layer by various methods described in *Research Disclosure* No. 169 (RD-16928), U.S. Pat. No.

2,739,890, U.K. Patent 813,253 and West German Patent 1,547,763.

Fixing solutions having a conventional composition can be used. Examples of fixing agents include thiosulfates, thiocyanates and organosulfur compounds known as compounds which have an effect as a fixing agent. The fixing solutions may contain water-soluble aluminum salts as hardening agents.

The present invention will now be illustrated in greater detail by reference to the following examples which, however, are not to be construed as limiting the invention in any way. All parts, percents, and ratios are by weight unless stated otherwise.

EXAMPLE 1

A biaxially oriented blue-dyed polyethylene terephthalate film having a thickness of 175 μm was subjected to a corona discharge treatment. Both sides of the treated film were coated with the following layer in such an amount as to give the following coating weight. The coating was carried out by means of a wire bar coater. The coated film was dried at 175° C. for one minute. The resulting base was referred to as base A.

First Undercoat Layer (Polymer Layer)

| | |
|---|---|
| Butadiene-styrene copolymer latex (solid content: 40%, butadiene/styrene ratio = 31/69 by weight) The latex solution contained 0.4 wt % (based on the weight of solid in the latex) of the following compound as an emulsifying dispersant. $nC_6H_{13}OOCCH_2$ / $nC_6H_{13}OOCCH-SO_3Na$ | 0.16 g/m² |
| Sodium salt of 2,4-dichloro-6-hydroxy-s-triazine as a hardening agent | 4.2 mg/m² |

Preparation of Bases A-1 to A-14

Both sides of the undercoated film (polymer layer-coated film) were coated with the following layer in such an amount as to give the following coating weight. The coating was carried out by means of a wire bar coater. The coated film was dried. The drying temperature was changed in the range of from 50° to 180° C. at intervals of 10° C. to prepare samples. The samples were referred to as bases A-1 to A-14. The drying time was one minute.

Dye Layer

| | |
|---|---|
| Gelatin | 170 mg/m² |
| Dye 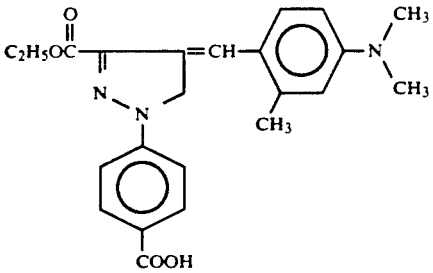 | 100 mg/m² |

-continued

| | |
|---|---|
| 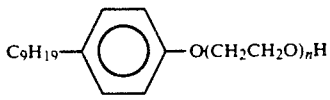 (n = 8.5) (Surface Active Agent) | 1.7 mg/m² |
| Matting agent (Polymethyl methacrylate having an average particle size of 2.5 μm) | 2.55 mg/m² |
| 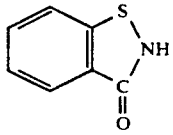 (Preservative) | 0.298 mg/m² |

Preparation of Base A-15

A base A-15 was prepared in the same way as in the preparation of the base A-1 to A-14, except that the dye was omitted from the coating solution for the dye layer and the drying temperature was 170° C.

Preparation of Base A-16

A base A-16 was prepared in the same way as in the preparation of the base A-11, except that the amount of gelatin used in the dye layer was 550 mg/m² and the amount of sodium salt of 2,4-dichloro-6-hydroxy s-triazine was 13.5 mg/m².

Preparation of DVe Solution

A dye was previously dissolved in an alkaline solution having a pH of 10.0, and the resulting solution was added to gelatin. The pH of the solution was adjusted to 5 by using HCl (0.1 N).

Preparation of Coating Solution for Emulsion Layer 5 g of potassium bromide, 0.05 g of potassium iodide and 2.5 cc of a 5% aqueous solution of thioether $HO(CH_2)_2S(CH_2)_2S(CH_2)_2OH$ were added to 1 liter of water. While the resulting solution was kept at 73° C. with stirring, an aqueous solution of 8.33 g of silver nitrate, an aqueous solution containing 5.94 g of potassium bromide and 0.726 g of potassium iodide were added to the solution over a period of 45 seconds by the double jet process. After 2.5 g of potassium bromide was added thereto, an aqueous solution containing 8.33 g of silver nitrate was added thereto over a period of 7.5 minutes at such a rate that the flow rate at the time of the completion of the addition was twice that at the time of the commencement of the addition. Subsequently, an aqueous solution of 153.34 g of silver nitrate and an aqueous solution of a mixture of potassium bromide and potassium iodide were added thereto over a period of 25 minutes by a controlled double jet process while keeping the potential at a pAg of 8.1. The addition was made at such an accelerating rate that the flow rate at the time of the completion of the addition was 8 times that at the time of the commencement of the addition. After the completion of the addition, 15 cc of a solution of 2N potassium thiocyanate was added thereto and then 50 cc of a 1% aqueous solution of potassium iodide was added thereto over a total period of 30 seconds. Thereafter, the temperature was lowered to 35° C., and soluble salts were removed by the precipitation method. The temperature was then raised to 40° C., and 68 g of gelatin and 7.5 g of trimethylol propane were added thereto. Subsequently, the pH was adjusted to 6.55 by using sodium hydroxide, and the pAg was adjusted to 8.10 by using potassium bromide.

After the temperature was raised to 56° C., 175 mg of 4-hydroxy-6-methyl-1,3,3a,7-tetraazaindene and 625 mg of the following sensitizing dye were added thereto. After 10 minutes, 5.5 mg of sodium thiosulfate pentahydrate, 163 mg of potassium thiocyanate and 3.6 mg of chloroauric acid were added. After 5 minutes, the mixture was quenched to solidify it. The resulting emulsion had a grain size distribution such that the projected area of grains having an aspect ratio of not lower than 3 accounted for 93% of the total projected area of all of the grains. With regard to all grains having an aspect ratio of not lower than 2, the average diameter of the projected area was 0.95 μm, the standard deviation was 23%, the average thickness was 0.155 μm and the aspect ratio was 6.1.

Sensitizing Dye:

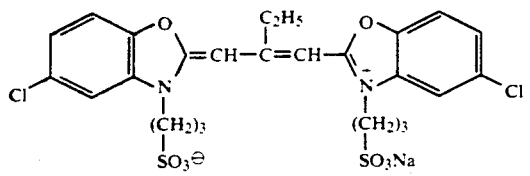

The following reagents were added per mol of silver halide to the emulsion to prepare a coating solution.

| | |
|---|---|
| 2,6-Bis(hydroxyamino)-4-diethylamino-1,3,5-triazine | 80 mg |
| Polysodium acrylate (average molecular weight (MW): 41,000) | 4.0 g |
| 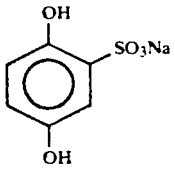 | 9.7 g |
| Ethyl acrylate/acrylic acid/methacrylic acid (95/2/3) copolymer latex | 20.0 g |
| Nitron | 50 mg |
| 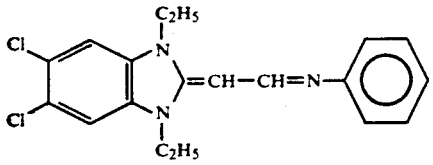 | 5.0 mg |

Both sides of each of the bases A-1 to A-16 were equally coated with the thus-prepared coating emulsion for the emulsion layer and a coating solution for a surface protective layer by means of a co-extrusion system to obtain each of the photographic materials A 1 to A-16.

The coating solution for the surface protective layer was prepared by adding the following composition (excluding gelatin) in a 2% aqueous gelatin solution at 40° C.

The coating weights of the emulsion layer and the surface protective layer per one side were the following amounts.

Emulsion Layer

| | |
|---|---|
| Amount of coated silver | 1.9 g/m$^2$ |
| Amount of coated gelatin | 1.5 g/m$^2$ |

Surface Protective Layer

| | |
|---|---|
| Gelatin | 0.81 g/m$^2$ |
| Dextran (average MW: 39,000) | 0.81 g/m$^2$ |
| Matting agent (polymethyl methacrylate/methacrylic acid (9/1) copolymer having an average particle size of 3.5 μm) | 0.06 g/m$^2$ |
| $C_8H_{17}$—⟨○⟩—$O(CH_2CH_2O)_{10}(CH_2\underset{\underset{OH}{\mid}}{C}HCH_2O)_3H$ | 60 mg/m$^2$ |
| $C_8H_{17}$—⟨○⟩—$O(CH_2CH_2O)_2CH_2CH_2SO_2Na$ | 20 mg/m$^2$ |
| $C_8F_{17}SO_2\underset{\underset{C_3H_7}{\mid}}{N}(CH_2CH_2O)_4(CH_2)_4SO_3Na$ | 2 mg/m$^2$ |
| $C_8F_{17}SO_2\underset{\underset{C_3H_7}{\mid}}{N}(CH_2CH_2O)_{15}H$ | 5 mg/m$^2$ |
| 4-Hydroxy-6-methyl-1,3,3a,7-tetraazaindene | 15.5 mg/m$^2$ |
| Polysodium acrylate (average MW: 41,000) | 70 mg/m$^2$ |

1,2-Bis(sulfonylacetamide)ethane was coated as a hardening agent in such an amount as to give a coating weight of 56 mg/m$^2$ per one side.

Evaluation of Photographic Performance

GRENEX ortho-screen HR-4 (a product of Fuji Photo Film Co., Ltd.) was brought into close contact with both sides of each photographic material by using a cassette, and X-ray sensitometry was carried out. Adjustment of the exposure amount was made by changing the distance between X-ray bulb and the cassette. After exposure, the photographic materials were processed in an automatic processor by using the following developing solution and fixing solution.

Measurement of Sharpness (MTF)

MTF (modulation transfer function) was measured by using a combination of the HR-4 screen with the processing in the automatic processor. Measurement was made with an aperture of 30 μm×500 μm. Evaluation was made at a part of an optical density of 1.0 by using an MTF value where the spatial frequency was 1.0 cycle/mm. Details of MTF are described in T.H. James, *The Theory of the Photographic Process*, (1977, Macmillan Publishing Co., Inc.), pp. 592–618.

Measurement of Residual Color

After unexposed films were subjected to the automatic processing, the density of green color transmitted light was measured with X-Rite (an optical densitometer manufactured by The X-Rite Company).

Evaluation of Cross-over

GRENEX ortho-screen HR-4 was brought into close contact with one side of each sample by using a cassette, and X-ray sensitometry was carried out. After the same processing as that for the evaluation of photographic performance was made, the cross-over value was calculated from the following formula by using a difference in sensitivity (log E) between the surface contacted with the screen (the front side) and the other surface (the back side).

$$\% = \frac{1}{\text{anti}\log(\Delta\log E) + 1} \times 100$$

Processing

| | |
|---|---|
| Development | 35° C. × 9.5 sec |
| Fixing | 31° C. × 10 sec |
| Rinse | 15° C. × 6 sec |
| Squeeze | 6 sec |
| Drying | 50° C. × 12 sec |
| Dry to Dry Processing Time | 45 sec |

(When an undried sample was obtained, the sample was air-dried after processing.)

The developing solution and the fixing solution had the following compositions.

| | |
|---|---|
| Potassium hydroxide | 29 g |
| Potassium sulfite | 44.2 g |
| Sodium hydrogencarbonate | 7.5 g |
| Boric acid | 1.0 g |
| Diethylene glycol | 12 g |
| Ethylenediaminetetraacetic acid | 1.7 g |
| 5-Methylbenztriazole | 0.06 g |
| Hydroquinone | 25 g |
| Glacial acetic acid | 18 g |
| Triethylene glycol | 12 g |
| 5-Nitroindazole | 0.25 |
| 1-Phenyl-3-pyrazolidone | 2.8 g |
| Glutaraldehyde (50 wt/wt %) | 9.86 g |
| Sodium metabisulfite | 12.6 g |
| Potassium bromide | 3.7 g |
| Water added | 1.0 liter |

Fixing Solution

| | |
|---|---|
| Ammonium thiosulfate (70 wt/vol %) | 200 ml |
| Disodium ethylenediaminetetraacetate dihydrate | 0.02 g |
| Sodium sulfite | 15 g |
| Boric acid | 10 g |
| Sodium hydroxide | 6.7 g |
| Glacial acetic acid | 15 g |
| Aluminum sulfate | 10 g |
| Sulfuric acid (36N) | 3.9 g |

The total amount was made 1 liter by adding water. (The pH thereof was adjusted to 4.25).

Evaluation of Adhesion in the Developing Solution

Three parallel scratches were made on the emulsion surface of the sample. The sample was immersed in the automatic developing solution at 26° C for 2 minutes. The emulsion surface of the sample was then rubbed 10 times with silicone rubber under a load of 1 kg/cm$^2$. Evaluation was made by the following criterion.

The mark × means that the emulsion layer peeled off by rubbing.

The mark × means that only the emulsion layer around the scratches peeled off by rubbing.

The mark × means that the emulsion layer did not peel off by rubbing.

Evaluation of Drying Characteristics

Evaluation wa made by the following criterion.

The mark ○ means that the photographic material leaving the automatic processor after processing was in a dried state.

The mark × means that the photographic material leaving the automatic processor after processing was still in an undried state.

Evaluation Results (1) Cross-over

| | | |
|---|---|---|
| Photographic materials | A-1 to 14 | 2% |
| " | A-15 | 30 |
| " | A-16 | 2 |

(2) MTF

| | | |
|---|---|---|
| Photographic materials | A-1 to 14 | 0.72% |
| " | A-15 | 0.51 |
| " | A-16 | 0.72 |

(3) The results for the residual color, adhesion and drying characteristics are shown in Table 1.

It is apparent from the above test results that when the amount of hydrophilic colloid in the dye layer is not more than 0.5 g/m$^2$ and the drying temperature of the dye layer is in the range of 80° to 160° C., image quality can be improved and photographic materials having excellent properties with regard to the residual color, adhesion and drying characteristics after processing can be obtained.

TABLE 1

| Photographic Material | Drying Temperature of Dye Layer (°C.) | Residual Color after Processing | Adhesion in Developing Solution | Drying Characteristics |
|---|---|---|---|---|
| A-1 (Comp. Ex.) | 50 | 0.030 | xx | ○ |
| A-2 (Comp. Ex.) | 60 | 0.029 | xx | " |
| A-3 (Comp. Ex.) | 70 | 0.029 | x | " |
| A-4 (Invention) | 80 | 0.030 | ○ | " |
| A-5 (Invention) | 90 | 0.031 | " | " |
| A-6 (Invention) | 100 | 0.030 | " | " |
| A-7 (Invention) | 110 | 0.032 | " | " |
| A-8 (Invention) | 120 | 0.030 | " | " |
| A-9 (Invention) | 130 | 0.031 | " | " |
| A-10 (Invention) | 140 | 0.032 | " | " |
| A-11 (Invention) | 150 | 0.034 | " | " |
| A-12 (Invention) | 160 | 0.035 | " | " |
| A-13 (Comp. Ex.) | 170 | 0.070 | " | " |
| A-14 (Comp. Ex.) | 180 | 0.130 | " | " |
| A-15 (Comp. Ex.) | 170 | 0.030 | " | " |
| A-16 (Comp. Ex.) | 150 | 0.038 | " | x |

EXAMPLE 2

The procedure of Example 1 was repeated, except that the first undercoat layer (polymer layer) was coated with the following reagents in such amounts as to give the following coating weights to prepare photographic materials B-1 to B-16.

First Undercoat Layer (Polymer Layer)

| | |
|---|---|
| Vinylidene chloride latex (vinylidene chloride/methacrylic acid/methyl acrylate/methyl methacrylate/acrylonitrile ratio = 90/0.3/4/4/1.7 by weight) | 2.9 g/m$^2$ |
| Sodium salt of 2,4-dichloro-6-hydroxy-s-triazine | 4.4 mg/m$^2$ |

Evaluation Results (1) Cross-over

| | | |
|---|---|---|
| Photographic materials | B-1 to 14 | 2% |
| " | B-15 | 30 |
| " | B-16 | 2 |

(2) MTF

| | | |
|---|---|---|
| Photographic materials | B-1 to 14 | 0.72% |
| " | B-15 | 0.51 |
| " | B-16 | 0.72 |

(3) The results for the residual color, adhesion and drying characteristics are shown in Table 2.

It is apparent from the above results that when the amount of hydrophilic colloid in the dye layer is not more than 0.5 g/m$^2$ and the drying temperature of the dye layer is in the range of 80° to 160° C., image quality can be improved and photographic materials having excellent properties with regard to the residual color, adhesion and drying characteristics after processing can be obtained.

TABLE 2

| Photographic Material | Drying Temperature of Dye Layer (°C.) | Residual Color after Processing | Adhesion in Developing Solution | Drying Characteristics |
|---|---|---|---|---|
| B-1 (Comp. Ex.) | 50 | 0.029 | xx | ○ |
| B-2 (Comp. Ex.) | 60 | 0.028 | xx | " |
| B-3 (Comp. Ex.) | 70 | 0.030 | x | " |
| B-4 (Invention) | 80 | 0.031 | ○ | " |
| B-5 (Invention) | 90 | 0.032 | " | " |
| B-6 (Invention) | 100 | 0.031 | " | " |
| B-7 (Invention) | 110 | 0.032 | " | " |
| B-8 (Invention) | 120 | 0.033 | " | " |
| B-9 (Invention) | 130 | 0.033 | " | " |
| B-10 (Invention) | 140 | 0.034 | " | " |
| B-11 (Invention) | 150 | 0.035 | " | " |
| B-12 (Invention) | 160 | 0.037 | " | " |
| B-13 (Comp. Ex.) | 170 | 0.061 | " | " |
| B-14 (Comp. Ex.) | 180 | 0.100 | " | " |
| B-15 (Comp. Ex.) | 170 | 0.028 | " | " |
| B-16 (Comp. Ex.) | 150 | 0.039 | " | x |

EXAMPLE 4

The procedure of Example 1 was repeated, except that the first undercoat layer (polymer layer) was coated with the following reagents in such amounts as to give the following coating weights to prepare photographic materials C-1 to C-16.

First Undercoat Layer

| | |
|---|---|
| Aqueous polyester WD-SIZE (a product of Eastman Kodak Co.) | 0.16 g/m$^2$ |
| Sodium salt of 2,4-dichloro-6-hydroxy-s-triazine | 3.8 mg/m$^2$ |
| Diisooctyl sodium sulfosuccinate | 0.04 mg/m$^2$ |

Evaluation Results (1) Cross-over

| | | |
|---|---|---|
| Photographic materials | C-1 to 14 | 2% |
| " | C-15 | 30 |
| " | C-16 | 2 |

(2) MTF

| | | |
|---|---|---|
| Photographic materials | C-1 to 14 | 0.72% |
| " | C-15 | 0.51 |
| " | C-16 | 0.72 |

(3) The results for the residual color, adhesion and drying characteristics are shown in Table 3.

It is apparent from the above results that when the amount of hydrophilic colloid in the dye layer is not more than 0.5 g/m$^2$ and the drying temperature of the dye layer is in the range of 80° to 160° C., image quality can be improved and photographic materials having excellent properties with regard to the residual color, adhesion and drying characteristics after processing can be obtained.

TABLE 3

| Photographic Material | Drying Temperature of Dye Layer (°C.) | Residual Color after Processing | Adhesion in Developing Solution | Drying Characteristics |
|---|---|---|---|---|
| C-1 (Comp. Ex.) | 50 | 0.031 | xx | ○ |
| C-2 (Comp. Ex.) | 60 | 0.032 | xx | " |
| C-3 (Comp. Ex.) | 70 | 0.031 | x | " |
| C-4 (Invention) | 80 | 0.032 | ○ | " |
| C-5 (Invention) | 90 | 0.032 | " | " |
| C-6 (Invention) | 100 | 0.033 | " | " |
| C-7 (Invention) | 110 | 0.032 | " | " |
| C-8 (Invention) | 120 | 0.031 | " | " |
| C-9 (Invention) | 130 | 0.033 | " | " |
| C-10 (Invention) | 140 | 0.034 | " | " |
| C-11 (Invention) | 150 | 0.036 | " | " |
| C-12 (Invention) | 160 | 0.038 | " | " |
| C-13 (Comp. Ex.) | 170 | 0.07 | " | " |
| C-14 (Comp. Ex.) | 180 | 0.150 | " | " |
| C-15 (Comp. Ex.) | 170 | 0.032 | " | " |
| C-16 (Comp. Ex.) | 150 | 0.038 | " | x |

EXAMPLE 4

The procedure of Example 1 was repeated, except that the first undercoat layer (polymer layer) was coated with the following reagents in such amounts as to give the following coating weights to prepare photographic materials D-1 to D-16.

First Undercoat Layer

| | |
|---|---|
| Polyacrylate (Jurimar ET410, a product of Nippon Junyaku KK) | 0.16 g/m$^2$ |
| Sodium salt of 2,4-dichloro-6- | 6.5 mg/m$^2$ |

-continued

| | | |
|---|---|---|
| hydroxy-s-triazine | | |

Evaluation Results (1) Cross-over

| | | |
|---|---|---|
| Photographic materials | D-1 to 14 | 2% |
| Photographic materials | D-15 | 30 |
| Photographic materials | D-16 | 2 |

(2) MTF

| | | |
|---|---|---|
| Photographic materials | D-1 to 14 | 0.72% |
| Photographic materials | D-15 | 0.51 |
| Photographic materials | D-16 | 0.72 |

(3) The results for the residual color, adhesion and drying characteristics are shown in Table 4.

It is clear from the above results that when the amount of hydrophilic colloid in the dye layer is not more than 0.5 g/m$^2$ and the drying temperature of the dye layer is in the range of 80° to 160° C., image quality can be improved and photographic materials having excellent properties with regard to the residual color, adhesion and drying characteristics after processing can be obtained.

TABLE 4

| Photographic Material | Drying Temperature of Dye Layer (°C.) | Residual Color after Processing | Adhesion in Developing Solution | Drying Characteristics |
|---|---|---|---|---|
| D-1 (Comp. Ex.) | 50 | 0.028 | xx | |
| D-2 (Comp. Ex.) | 60 | 0.029 | xx | " |
| D-3 (Comp. Ex.) | 70 | 0.028 | x | " |
| D-4 (Invention) | 80 | 0.030 | | " |
| D-5 (Invention) | 90 | 0.031 | " | " |
| D-6 (Invention) | 100 | 0.030 | " | " |
| D-7 (Invention) | 110 | 0.032 | " | " |
| D-8 (Invention) | 120 | 0.031 | " | " |
| D-9 (Invention) | 130 | 0.030 | " | " |
| D-10 (Invention) | 140 | 0.034 | " | " |
| D-11 (Invention) | 150 | 0.035 | " | " |
| D-12 (Invention) | 160 | 0.035 | " | " |
| D-13 (Comp. Ex.) | 170 | 0.100 | " | " |
| D-14 (Comp. Ex.) | 180 | 0.150 | " | " |
| D-15 (Comp. Ex.) | 170 | 0.030 | " | " |
| D-16 (Comp. Ex.) | 150 | 0.038 | " | x |

EXAMPLE 5

A biaxially oriented polyethylene terephthalate film having a thickness of 100 μm was subjected to a corona discharge treatment. One side of the treated film was then coated with the following polymer layer and the other side was coated with the following electrically conductive layer in such amounts as to give the following coating weight. The coating was carried out by means of a wire bar coater. The coated film was dried at 170° C. for one minute.

First Surface Layer (Polymer Layer)

| | |
|---|---|
| Butadiene-styrene copolymer latex (solid content: 40%, butadiene/styrene ratio = 31/69 by weight) | 0.16 g/m$^2$ |

-continued

| | |
|---|---|
| the latex solution contained 0.4 wt % (based on the weight of solid in the latex) of the following compound as an emulsifying dispersant. $nC_6H_{13}OOCCH_2$ / $nC_6H_{13}OOCCH—SO_3Na$ | |
| Sodium salt of 2,4-dichloro-6-hydroxy-s-triazine | 4.2 mg/m$^2$ |

First Back Layer (Electrically Conductive Back Layer)

| | |
|---|---|
| Polyacrylate, Jurimar ET410 | 28 mg/m$^2$ |
| $SnO_2$/Sb | 170 mg/m$^2$ |

Preparation of Bases E-1 to E-14

The surface of the first undercoat layer (polymer layer) was coated with the following layer in such an amount as to give the following coating weight.

The coating was carried out by means of a wire bar coater. The drying temperature was changed in the range of from 50° to 180° C. at intervals of 10° C. to prepare samples. The samples were referred to as samples E-1 to E-14. The drying time was one minute.

Second Surface Layer (Dye Layer)

Gelatin — 100 mg/m$^2$

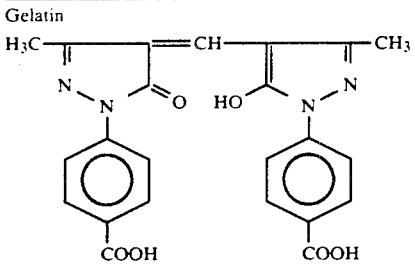

30 mg/m$^2$ (dye)

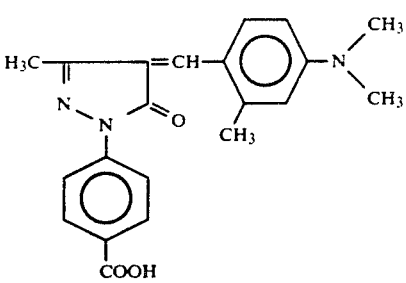

90 mg/m$^2$ (dye)

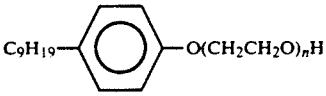

(n = 8.5) — 0.68 mg/m$^2$

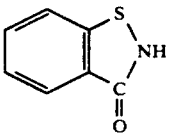

0.12 mg/m$^2$

-continued

| | |
|---|---|
| Matting agent (Polymethyl methacrylate having an average particle size of 2.5 μm) | 1.36 mg/m² |

Second Back Layer

| | |
|---|---|
| Polyolefin (Ethylene/methacrylic acid copolymer) | 113 mg/m² |
| Colloidal silica (Snowtex C) | 66 mg/m² |

Preparation of Base E-15

A base E-15 was prepared in the same way as in the preparation of the bases E-1 to E-14, except that the dyes were omitted from the coating solution for the dye layer and the drying temperature was 170° C.

Preparation of Emulsion Coating Solution

| | |
|---|---|
| Solution I (at 75° C.) | |
| Inert gelatin | 24 g |
| Distilled water | 900 ml |
| KBr | 4 g |
| Aqueous solution of 10% phosphoric acid | 2 ml |
| Sodium benzenesulfinate | $5 \times 10^{-2}$ mol |
| 1,2-Bis(2-hydroxyethylthio)ethane | $2.5 \times 10^{-2}$ g |
| Solution II (at 35° C.) | |
| Silver nitrate | 170 g |
| Distilled water added | to make 1000 ml |
| Solution III (at 35° C.) | |
| KBr | 230 g |
| Distilled water added | to make 1000 ml |
| Solution IV (at room temperature) | |
| Potassium hexacyanoferrate (II) | 3.0 mg |
| Distilled water added | to make 1000 ml |

Solution II and Solution III were simultaneously added to Solution I, which was well stirred, over a period of 45 minutes. When the addition of Solution II was completed, a cubic monodisperse emulsion having an average grain size of 0.28 μm was obtained.

During the addition of Solution II and Solution III, Solution III was added at such a rate that the pAg value in the mixing container was always kept at 7.50 while adjusting the pAg value. 5 minutes after commencing the addition of Solution II, Solution IV was added thereto over a period of 5 minutes. After completing the addition of Solution II, water washing and desalting were carried out by precipitation method. Thereafter, the resulting emulsion was dispersed in an aqueous solution containing 100 g of inert gelatin. 34 mg of sodium thiosulfate per mol of silver and 34 mg of chloroauric acid tetrahydrate per mol of soliver were added to the resulting emulsion. After the pH and pAg were adjusted to 8.9 and 7.0 (at 40° C.), chemical sensitization treatment was carried out at 75° C. for 60 minutes to obtain a surface latent image type silver halide emulsion.

Preparation of Photographic Materials E-1 to E-15

The thus-obtained coating solution for the emulsion layer was coated on each of the bases E-1 to E-15 to obtain photographic materials E-1 to E-15.

The coating weights of the emulsion layer and the surface protective layer were the following amounts.

| | |
|---|---|
| Silver halide emulsion | 170 mg/m² (as silver) |

-continued

Sensitizing dye 23.8 mg/m²

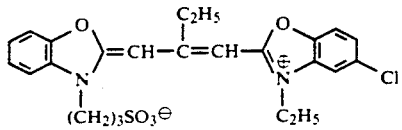

| | |
|---|---|
| 5-Methylbenztriazole | 4.1 mg/m² |
| Sodium dodecylbenzenesulfonate | 5 mg/m² |
| 1,3-Bis(vinylsulfonyl)-2-propanol | 56 mg/m² |
| Polysodium styrenesulfonate | 35 mg/m² |

Protective Layer

| | |
|---|---|
| Inert gelatin | 1300 mg/m² |
| Colloidal silica | 249 mg/m² |
| Liquid paraffin | 60 mg/m² |
| Strontium barium sulfate (average particle size: 1.5 μm) | 32 mg/m² |
| Proxel | 4.3 mg/m² |
| Sodium dodecylbenzenesulfonate | 4.0 mg/m² |
| Potassium salt of N-perfluorooctane-sulfonyl-N-propylglycine | 5.0 mg/m² |
| 1,3-Bis(vinylsulfonyl)-2-propanol | 56 mg/m² |
| 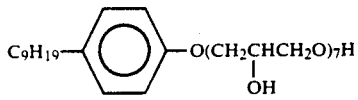 | 15 mg/m² |

Exposure and Development of Coated Samples (a) Imagewise exposure

Imagewise exposure was carried out through a continuous density wedge from the emulsion-coated side under a safelight for $10^{-3}$ seconds by using MARK-II xenon flash sensitometer.

(b) Reversal development

Reversal development was carried out under the following conditions by using commercially available reversal developing solutions (FR-531, 532, 533, 534, and 535, manufactured by FR Chemicals, U.S.A.) and a deep tank type automatic processor for reversal (F-10R, manufactured by Allen Products, U.S.A.). Reversal Development Conditions:

| Stage | Processing Solution | Temp. | Time |
|---|---|---|---|
| 1. First Development | FR-531(1:3)* | 43° C. | 15 sec |
| 2. Rinse | Running water | " | " |
| 3. Bleaching | FR-532(1:3) | " | " |
| 4. Cleaning | FR-533(1:3) | " | " |
| 5. Exposure | — | — | — |
| 6. Second Development | FR-534(1:3) | " | " |
| 7. Fixing | FR-535(1:3) | " | " |
| 8. Rinse | Spray | " | " |
| 9. Drying | Hot air | — | — |

*The indicated agent is diluted with water at a weight ratio of 1:3 to prepare the processing solution.

Measurement of Residual Color

After unexposed film was subjected to the automatic processing, the density of blue color transmitted light was measured with the X-Rite optical densitometer.

Evaluation of Adhesion in Developing Solution

Three parallel scratches were made on the emulsion surface of the sample. The sample was immersed in the automatic developing solution (RUN #1) at 26° C. for 2 minutes. The emulsion surface of the sample was then rubbed 10 times with silicone rubber under a load of 1 kg/cm$^2$.

Evaluation was made by the following criterion.

The mark ×× means that the emulsion layer peeled off by rubbing.

The mark × means that only the emulsion layer around the scratches peeled off by rubbing.

The mark ○ means that the emulsion layer did not peel off by rubbing.

TABLE 5

| Photographic Material | Drying Temperature of Dye Layer (°C.) | Residual Color after Processing | Adhesion in Developing Solution |
|---|---|---|---|
| E-1 (Comp. Ex.) | 50 | 0.038 | xx |
| E-2 (Comp. Ex.) | 60 | 0.038 | xx |
| E-3 (Comp. Ex.) | 70 | 0.039 | x |
| E-4 (Invention) | 80 | 0.040 | |
| E-5 (Invention) | 90 | 0.041 | " |
| E-6 (Invention) | 100 | 0.040 | " |
| E-7 (Invention) | 110 | 0.039 | " |
| E-8 (Invention) | 120 | 0.040 | " |
| E-9 (Invention) | 130 | 0.041 | " |
| E-10 (Invention) | 140 | 0.044 | " |
| E-11 (Invention) | 150 | 0.044 | " |
| E-12 (Invention) | 160 | 0.045 | " |
| E-13 (Comp. Ex.) | 170 | 0.062 | " |
| E-14 (Comp. Ex.) | 180 | 0.075 | " |
| E-15 (Comp. Ex.) | 170 | 0.038 | " |

It is apparent from Table 5 that photographic materials having excellent properties with regard to residual color and adhesion can be obtained when the drying temperature of the dye layer is in the range of 80° to 160° C. according to the present invention.

EXAMPLE 6

The procedure of Example 5 was repeated, except that the first undercoat layer (polymer layer) was coated with the following reagents in such amounts as to give the following coating weights to obtain photographic materials F-1 to F-15.

First Undercoat Layer (Polymer Layer)

| | |
|---|---|
| Vinylidene chloride layer (vinylidene chloride/methacrylic acid/methyl acrylate/methyl methacrylate/acrylonitrile ratio = 90/0.3/4/4/1.7 by weight) | 0.29 g/m$^2$ |
| Sodium salt of 2,4-dichloro-6-hydroxy-s-triazine | 4.4 mg/m$^2$ |

TABLE 6

| Photographic Material | Drying Temperature of Dye Layer (°C.) | Residual Color after Processing | Adhesion in Developing Solution |
|---|---|---|---|
| F-1 (Comp. Ex.) | 50 | 0.040 | xx |
| F-2 (Comp. Ex.) | 60 | 0.040 | xx |
| F-3 (Comp. Ex.) | 70 | 0.041 | x |
| F-4 (Invention) | 80 | 0.040 | |
| F-5 (Invention) | 90 | 0.041 | " |
| F-6 (Invention) | 100 | 0.040 | " |
| F-7 (Invention) | 110 | 0.039 | " |
| F-8 (Invention) | 120 | 0.040 | " |
| F-9 (Invention) | 130 | 0.040 | " |
| F-10 (Invention) | 140 | 0.041 | " |
| F-11 (Invention) | 150 | 0.045 | " |
| F-12 (Invention) | 160 | 0.045 | " |
| F-13 (Comp. Ex.) | 170 | 0.060 | " |
| F-14 (Comp. Ex.) | 180 | 0.080 | " |
| F-15 (Comp. Ex.) | 170 | 0.040 | " |

It is apparent from Table 6 that photographic materials having excellent properties with regard to residual color and adhesion can be obtained when the drying temperature of the dye layer is in the range of 80° to 160° C., according to the present invention.

EXAMPLE 7

The procedure of Example 5 was repeated, except that the first undercoat layer (polymer layer) was coated with the following reagents in such amounts as to give the following coating weights to obtain photographic materials G-1 to G-15.

First Undercoat Layer (Polymer Layer)

| | |
|---|---|
| Aqueous polyester (WD-SIZE) | 0.16 g/m$^2$ |
| Sodium salt of 2,4-dichloro-6-hydroxy-s-triazine | 3.8 mg/m$^2$ |
| Diisooctyl sodium sulfosuccinate | 0.04 mg/m$^2$ |

TABLE 7

| Photographic Material | Drying Temperature of Dye Layer (°C.) | Residual Color after Processing | Adhesion in Developing Solution |
|---|---|---|---|
| G-1 (Comp. Ex.) | 50 | 0.041 | xx |
| G-2 (Comp. Ex.) | 60 | 0.041 | xx |
| G-3 (Comp. Ex.) | 70 | 0.040 | x |
| G-4 (Invention) | 80 | 0.041 | |
| G-5 (Invention) | 90 | 0.042 | " |
| G-6 (Invention) | 100 | 0.041 | " |
| G-7 (Invention) | 110 | 0.041 | " |
| G-8 (Invention) | 120 | 0.040 | " |
| G-9 (Invention) | 130 | 0.041 | " |
| G-10 (Invention) | 140 | 0.041 | " |
| G-11 (Invention) | 150 | 0.041 | " |
| G-12 (Invention) | 160 | 0.045 | " |
| G-13 (Comp. Ex.) | 170 | 0.060 | " |
| G-14 (Comp. Ex.) | 180 | 0.085 | " |
| G-15 (Comp. Ex.) | 170 | 0.040 | " |

It is apparent from Table 7 that photographic materials having excellent properties with regard to residual color and adhesion can be obtained when the drying temperature of the dye layer is in the range of 80° to 160° C. according to the present invention.

EXAMPLE 8

The procedure of Example 5 was repeated, except that the first undercoat layer (polymer layer) was coated with the following reagents in such amounts as to give the following coating weights to obtain photographic materials H-1 to H-15.

First Undercoat Layer (Polymer Layer)

| | |
|---|---|
| Polyacrylate (Julimar ET410) | 0.16 g/m² |
| Sodium salt of 2,4-dichloro-6-hydroxy-s-triazine | 3.8 mg/m² |

TABLE 8

| Photographic Material | Drying Temperature of Dye Layer (°C.) | Residual Color after Processing | Adhesion in Developing Solution |
|---|---|---|---|
| H-1 (Comp. Ex.) | 50 | 0.041 | xx |
| H-2 (Comp. Ex.) | 60 | 0.040 | xx |
| H-3 (Comp. Ex.) | 70 | 0.042 | x |
| H-4 (Invention) | 80 | 0.042 | |
| H-5 (Invention) | 90 | 0.040 | " |
| H-6 (Invention) | 100 | 0.040 | " |
| H-7 (Invention) | 110 | 0.040 | " |
| H-8 (Invention) | 120 | 0.039 | " |
| H-9 (Invention) | 130 | 0.039 | " |
| H-10 (Invention) | 140 | 0.040 | " |
| H-11 (Invention) | 150 | 0.040 | " |
| H-12 (Invention) | 160 | 0.045 | " |
| H-13 (Comp. Ex.) | 170 | 0.060 | " |
| H-14 (Comp. Ex.) | 180 | 0.070 | " |
| H-15 (Comp. Ex.) | 170 | 0.039 | " |

It is clear that Table 8 that photographic materials having excellent properties with regard to residual color and adhesion can be obtained when the drying temperature of the dry layer is in the range of 80° to 160° C. according to the present invention.

The preferred embodiments of the present invention are as follows:

(1) A silver halide photographic material comprising a support having on at least one side thereof an undercoat polymer adjacent to the support, a dye layer and at least one silver halide emulsion layer in that order from the side of the support, wherein hydrophilic colloid in the dye layer is present at a coating weight of not more than about 0.5 g/m² and the dye layer is dried at a temperature in the range of from about 80° to about 160° C.

(2) A silver halide photographic material as described in the above item (1), wherein the ratio by weight of dye/hydrophilic colloid in the dye layer is at least 0.3.

(3) A silver halide photographic material as described in the above item (1) or (2), wherein the drying temperature of the dye layer is in the range of 100° to 160° C.

(4) A silver halide photographic material as described in any one of the above items (1) to (3), wherein the undercoat polymer is formed from latex.

(5) A silver halide photographic material as described in any one of the above items (1) to (4), wherein the dye in the dye layer is fixed to the dye layer by allowing the dye to be adsorbed by a mordant.

(6) A silver halide photographic material as described in any one of the above items (1) to (4), wherein the dye in the dye layer is fixed to the dye layer by dispersing the dye in the form of a solid.

(7) A silver halide photographic material as described in any one of the above items (1) to (4), wherein the dye in the dye layer is fixed to the dye layer by allowing the dye to be adsorbed by a polymer.

(8) A silver halide photographic material as described in any one of the above items (1) to (4), wherein the dye in the dye layer is fixed to the dye layer by dissolving the dye in oil and then emulsion-dispersing the dissolved dye as oil droplets.

(9) A silver halide photographic material as described in the above item (5), wherein the dye has a dye structure described in Japanese Patent Application No. 62-224447.

(10) A silver halide photographic material as described in the above item (6), wherein the dye has a dye structure described in WO 88/04794.

(11) A silver halide photographic material as described in the above item (7), wherein the dye has a dye structure described in Japanese Patent Application No. 1-119851.

(12) A silver halide photographic material as described in the above item (8), wherein the dye has a dye structure described in Japanese Patent Application No. 1-142688.

While the invention has been described in detail and with reference to specific embodiments thereof, it will be apparent to one skilled in the art that various changes and modifications can be made therein without departing from the spirit and scope thereof.

What is claimed is:

1. A silver halide photographic element comprising a support having on at least one side thereof an undercoat hydrophobic polymer layer, a dye layer comprising hydrophilic colloid and a dye capable of being decolorized during development, and at least one silver halide emulsion layer in that order from the side of the support, wherein the hydrophilic colloid in the dye layer is present at a coating weight of not more than about 0.5 g/m², the dye layer is present in an amount of from 1 to 1,000 mg/m², and the dye layer is dried at a temperature in the range of from about 80° to about 160° C.

2. A silver halide photographic element as claimed in claim 1, wherein the hydrophilic colloid and the dye are present in the dye layer in a dye/hydrophilic colloid weight ratio of at least about 0.15.

3. A silver halide photographic element as claimed in claim 1, wherein the drying temperature is in the range of 100° to 160° C.

4. A silver halide photographic element as claimed in claim 2, wherein the drying temperature is in the range of 100° to 160° C.

5. A silver halide photographic element as claimed in claim 3, wherein the drying temperature is in the range of 120° to 150° C.

6. A silver halide photographic element as claimed in claim 4, wherein the drying temperature is in the range of 120° to 150° C.

7. A silver halide photographic element as claimed in claim 1, wherein the undercoat polymer layer comprises a polymer selected from the group consisting of styrene-butadiene and vinylidene chloride copolymers.

8. A silver halide photographic element as claimed in claim 1, wherein the photographic material is a printing photographic material and the undercoat polymer layer comprises a hydrophobic polymer.

9. A silver halide photographic element as claimed in claim 8, wherein the hydrophobic polymer is a vinylidene chloride polymer.

10. A silver halide photographic element as claimed in claim 1, wherein the undercoat polymer layer comprises a latex polymer.

11. A silver halide photographic element as claimed in claim 2, wherein the undercoat polymer layer comprises a latex polymer.

12. A silver halide photographic element as claimed in claim 3, wherein the undercoat polymer layer comprises a latex polymer.

13. A silver halide photographic element as claimed in claim 4, wherein the undercoat polymer layer comprises a latex polymer.

14. A silver halide photographic element as claimed in claim 1, wherein the dye absorbs light in the light-sensitive region of the photographic material.

15. A silver halide photographic element as claimed in claim 1, wherein the dye layer is present in an amount of from 10 to 300 mg/m$^2$.

16. A silver halide photographic element as claimed in claim 1, wherein the dye layer comprises hydrophilic colloid in an amount of from 10 to 500 mg/m$^2$.

17. A silver halide photographic element as claimed in claim 15, wherein the dye layer comprises hydrophilic colloid in an amount of from 10 to 200 mg/m$^2$.

18. A silver halide photographic element as claimed in claim 2, wherein the dye/hydrophilic colloid weight ratio is at least 0.5.

19. A silver halide photographic element as claimed in claim 1, wherein the dye is fixed in the dye layer.

* * * * *